US008336157B2

(12) United States Patent
Aguila

(10) Patent No.: US 8,336,157 B2
(45) Date of Patent: Dec. 25, 2012

(54) SCRUBBING PAD

(76) Inventor: Romeo Valdez Aguila, Kaneohe, HI (US)

( * ) Notice: Subject to any disclaimer, the term of this patent is extended or adjusted under 35 U.S.C. 154(b) by 149 days.

(21) Appl. No.: 12/878,190

(22) Filed: Sep. 9, 2010

(65) Prior Publication Data

US 2012/0060314 A1 Mar. 15, 2012

(51) Int. Cl.
*A47L 13/12* (2006.01)
*A47L 17/08* (2006.01)

(52) U.S. Cl. ..... 15/229.12; 15/209.1

(58) Field of Classification Search ..... 15/229.12, 15/229.13, 209.1
See application file for complete search history.

(56) References Cited

U.S. PATENT DOCUMENTS

| | | | | | |
|---|---|---|---|---|---|
| 2,308,568 | A | * | 1/1943 | Rogers | 15/229.12 |
| 2,528,183 | A | * | 10/1950 | Schmidt | 156/148 |
| 2,845,650 | A | * | 8/1958 | Ashley et al. | 15/229.12 |
| 3,121,250 | A | * | 2/1964 | Johnson | 401/199 |
| 3,473,184 | A | * | 10/1969 | Buck, Jr. | 15/229.13 |
| 4,665,580 | A | * | 5/1987 | Morris | 15/118 |

* cited by examiner

*Primary Examiner* — Randall Chin
(74) *Attorney, Agent, or Firm* — Steven R. Gray

(57) ABSTRACT

A scrubbing pad includes a lesser abrasive scrubbing layer attached to a steel wool pad, resulting in a single unit that may be used for scrubbing a variety of surfaces. The two separate pads, having the same size, may be sandwiched together and may be connected together with, for example, a plurality of ties on each side of the sandwiched pads.

6 Claims, 2 Drawing Sheets

SCRUBBING PAD

BACKGROUND OF THE INVENTION

The present invention relates to scrubbing pad and, more particularly, to a scrubbing pad that includes different scrubbing surfaces on the same pad.

Conventional scrubbing pads may include, for example, a scrubbing pad, such a SCOTCH-BRITE™ pad, may include a scrubbing material. This material may be disposed opposite a sponge. In some circumstances, however, a steel wool pad, such as a BRILLO™ pad, may be useful for a more abrasive cleaning, as compared with a scrubbing pad. To switch between pads, a user must use either one pad or the other, or switch between pads.

As can be seen, there is a need for a scrubbing pad that may include, together in a single device, a lesser abrasive scrubbing pad and a more abrasive steel wool pad.

SUMMARY OF THE INVENTION

In one aspect of the present invention, a scrubbing pad comprises a first layer comprising steel wool; and a second layer formed of a material less abrasive than the first layer.

In another aspect of the present invention, a scrubbing pad comprises a steel wool layer; a nylon web-based material layer disposed against one side of the steel wool layer; and a plurality of ties joining the steel wool layer to the nylon web-based material layer.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a scrubbing pad having a lesser abrasive scrubbing layer attached to a steel wool pad, resulting in a single unit that may be used for scrubbing a variety of surfaces. The two separate pads, having the same size, may be sandwiched together and may be connected together with, for example, a plurality of ties on each side of the sandwiched pads.

Figure 1:
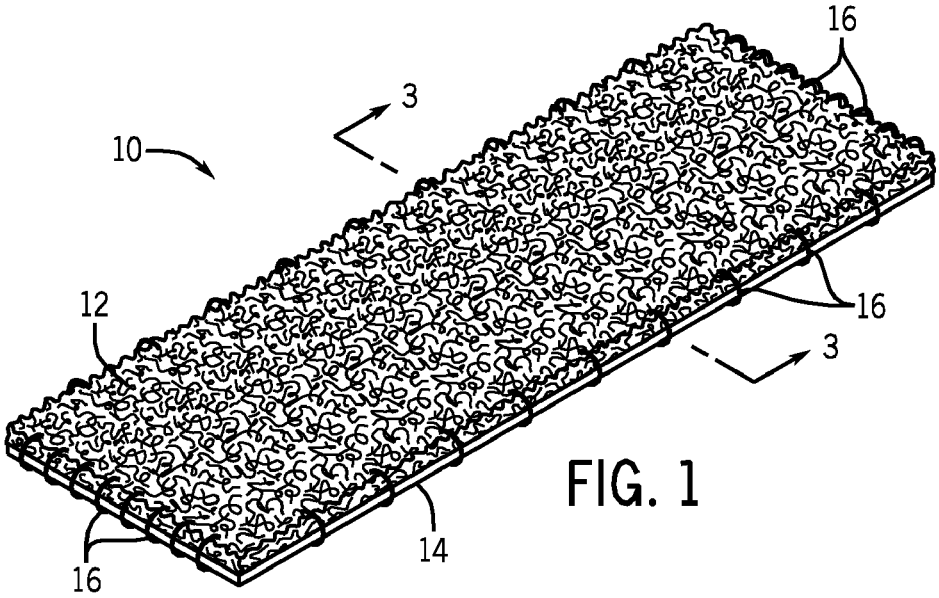
FIG. 1 is a top perspective view of the scrubbing pad according to an embodiment of the present invention.
Figure 2:
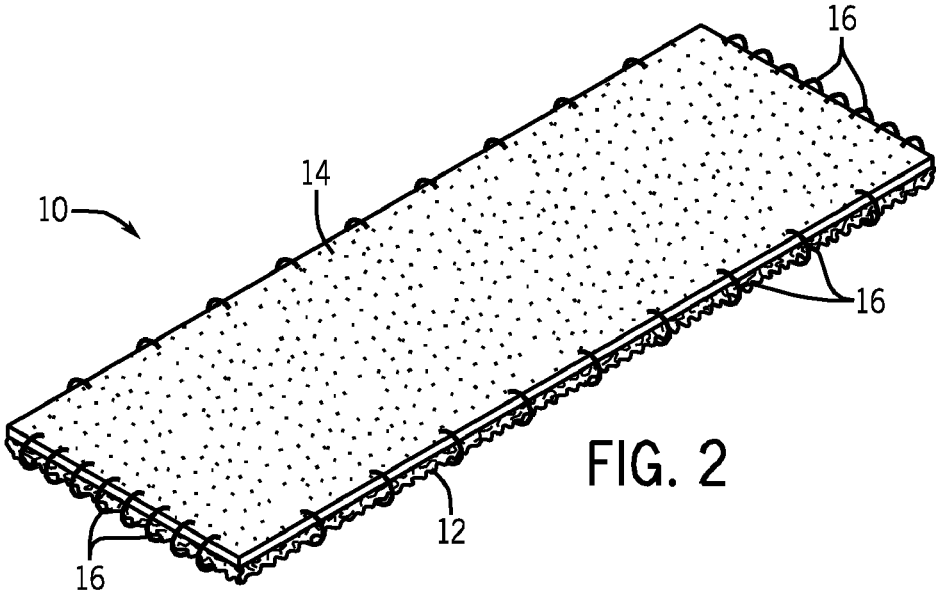
FIG. 2 is a bottom perspective view of the scrubbing pad of FIG. 1.
Figure 3:
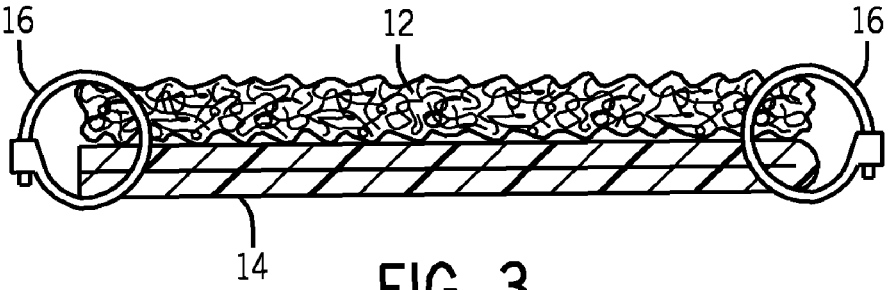
FIG. 3 is a cross-sectional view taken along line 3-3 of FIG. 1.
Figure 4:
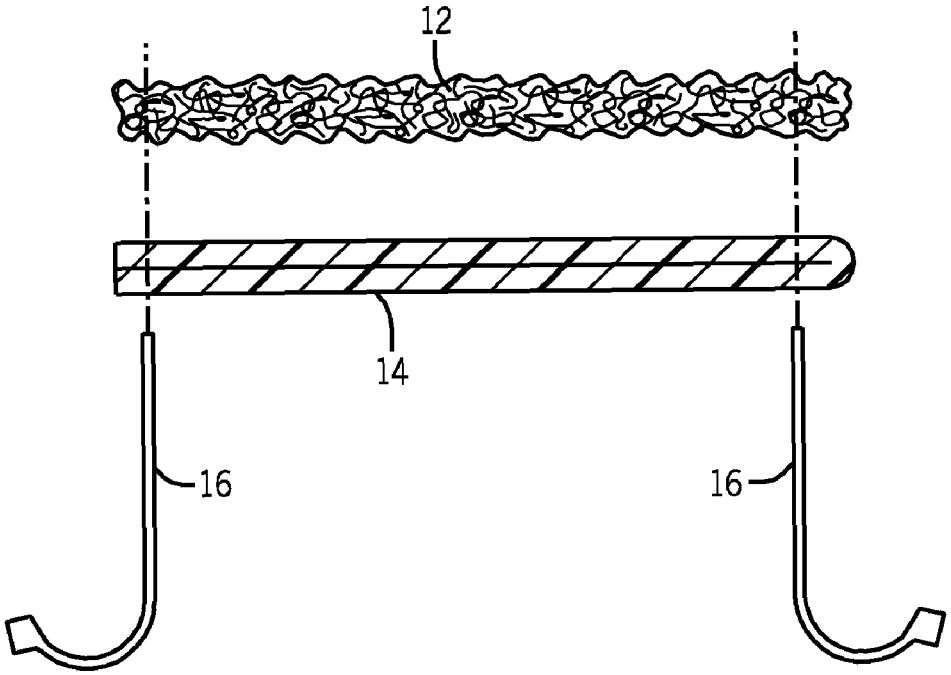
FIG. 4 is an exploded view of the cross-section of FIG. 3.

Referring to FIGS. 1 through 4, a scrubbing pad 10 may include a first layer 12 and a second layer 14. The first layer 12 may be formed from a layer of steel wool having a thickness from about 0.1 to about 1 inch, typically from about 0.2 to about 0.5 inch. The first layer 12 may be from about 2 to about 6 inches wide, typically about 4.5 inches wide, and from about 4 to about 8 inches long, typically about 6 inches long. The first layer 12 may be impregnated with a cleaning material, such as a detergent.

The second layer 14 may be formed from a layer of material having less abrasive properties than the first layer 12. In one embodiment, the second layer 14 may be a 3-dimensional nylon web-based material, such as a SCOTCH-BRITE™ pad. The second layer 14 may have a thickness from about 0.1 to about 1 inch, typically from about 0.2 to about 0.5 inch. The second layer 14 may be from about 2 to about 6 inches wide, typically about 4.5 inches wide, and from about 4 to about 8 inches long, typically about 6 inches long. In some embodiments, the second layer 14 is the same size as the first layer 12. In some embodiments, the second layer 14 may be made by folding a 6 inch by 9 inch pad in half to form a two-ply 6 inch by 4.5 inch pad.

The first layer 12 and the second layer 14 may be attached together to form a single pad. These layers 12, 14 may be attached together by means known in the art. In some embodiments, the first layer 12 and the second layer 14 may be attached together with a plurality of ties 16 connecting the layers 12, 14 together about a perimeter of the scrubbing pad 10. In some embodiments, the ties 16 may be plastic ties. In some embodiments, nine ties 16 may be used on each edge of the scrubbing pad 10.

The scrubbing pad 10 of the present invention may be used, for example, for cleaning various items. The first layer 12 may be used for cleaning surfaces that may not be subject to scratching or on surfaces that may require abrasive cleaning. The second layer 14 may be used for cleaning surfaces that may require more delicate cleaning. For example, the first layer 12 may be used to clean dishes, while the second layer 14 may be used to scrub pots and pans.

It should be understood, of course, that the foregoing relates to exemplary embodiments of the invention and that modifications may be made without departing from the spirit and scope of the invention as set forth in the following claims.

What is claimed is:

1. A scrubbing pad comprising:
- a first layer comprising steel wool; and
- a second layer formed of a material less abrasive than the first layer;
- the first layer being attached to the second layer;
- the first layer being the same size as the second layer;
- the first layer being sandwiched together against the second layer;
- wherein a plurality of ties are disposed about the perimeter of the scrubbing pad to hold the first layer and the second layer together.

2. The scrubbing pad of claim 1, wherein the ties are plastic ties.

3. A scrubbing pad comprising:
- a first layer comprising steel wool; and
- a second layer formed of a material less abrasive than the first layer;
- the second layer being a 3-dimensional nylon web-based material;
- wherein the nylon web-based material is formed from a sheet of material folded in half upon itself.

4. A scrubbing pad comprising:
- a steel wool layer;
- a nylon web-based material layer disposed against one side of the steel wool layer to the nylon web-based material layer; and
- a plurality of ties joining the steel wool layer to the nylon web-based material layer.

5. The scrubbing pad of claim 4, wherein the nylon web-based material layer is formed by folding a 6 inch by 9 inch sheet of nylon web-based material upon itself to form a 6 inch by 4.5 inch sheet.

6. The scrubbing pad of claim 5, wherein the steel wool layer is a 6 inch by 4.5 inch sheet disposed against one surface of the nylon web-based material layer.

* * * * *